US007128168B2

(12) United States Patent
Youan

(10) Patent No.: US 7,128,168 B2
(45) Date of Patent: Oct. 31, 2006

(54) REAMER APPARATUS FOR GROUND BORING MACHINE

(75) Inventor: Toyohiko Youan, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/807,516

(22) Filed: Mar. 24, 2004

(65) Prior Publication Data

US 2005/0034897 A1 Feb. 17, 2005

(30) Foreign Application Priority Data

Mar. 26, 2003 (JP) ..... 2003-086343

(51) Int. Cl.
*E21D 1/06* (2006.01)

(52) U.S. Cl. ..... 175/53; 175/406; 405/184.1

(58) Field of Classification Search ..... 175/61, 175/92, 101, 73, 317, 171, 53; 405/184.3, 405/184.1

See application file for complete search history.

(56) References Cited

U.S. PATENT DOCUMENTS 4,026,371 A * 5/1977 Takada et al. ..... 340/853.4
4,079,969 A * 3/1978 Wilson et al. ..... 285/98
4,176,985 A * 12/1979 Cherrington ..... 405/184
4,205,866 A * 6/1980 McCracken ..... 285/281
4,478,438 A * 10/1984 Elorriaga, Jr. ..... 285/276
5,176,211 A * 1/1993 Halderman et al. ..... 175/66
5,286,063 A * 2/1994 Huston ..... 285/11
5,375,669 A * 12/1994 Cherrington ..... 175/53
5,580,188 A * 12/1996 Nowak ..... 405/184
6,098,708 A * 8/2000 Jenne ..... 166/55.3
6,668,946 B1 * 12/2003 Rankin et al. ..... 175/62
6,752,433 B1 * 6/2004 Frost ..... 285/98
6,755,593 B1 * 6/2004 Wentworth et al. ..... 405/184.3
2003/0181245 A1 * 9/2003 Shaw ..... 464/163

FOREIGN PATENT DOCUMENTS

JP 9-195678 7/1997

* cited by examiner

*Primary Examiner*—David Bagnell
*Assistant Examiner*—Nicole Coy
(74) *Attorney, Agent, or Firm*—Armstrong, Kratz, Quintos, Hanson & Brooks, LLP.

(57) ABSTRACT

The invention provides a reamer apparatus for a ground boring machine that is capable of restricting increase in drawing resistance when performing drawing of a buried pipe by using a reamer and of efficiently performing drawing operations of the buried pipe without degrading properties such as flexibility and rotatability. The reamer apparatus includes a reamer main body of substantially hollow conical shape that reduces in diameter towards a drawing side, and a rod connecting portion that provided at a narrow diameter end portion of the reamer main body and connected with a rod. The reamer main body is connected to a buried pipe through a coupling structure disposed on an opposite side to the rod connecting portion. The coupling structure has a Swivel joint that allows rotation of the reamer main body with respect to the buried pipe, wherein a main portion of the Swivel joint is substantially accumulated in the reamer main body.

6 Claims, 11 Drawing Sheets

REAMER APPARATUS FOR GROUND BORING MACHINE

BACKGROUND OF THE INVENTION

1. Field of the Invention

The present invention relates to a reamer apparatus for a ground boring machine.

2. Description of the Related Art

A pipe burying method for burying a pipe such as a water pipe, a gas pipe, a drain pipe, a sheath pipe for a signal cable, and a fiber cable or the like (hereinafter, referred to as "a buried pipe") in the earth is roughly divided into a drive construction method for driving the earth and burying a pipe, and a non-drive construction method for burying a pipe without driving the earth. The both construction methods have an advantage and a disadvantage, respectively. In other words, as compared to the drive construction method, the non-drive construction method has an economical advantage such that a pipe can be easily buried as crossing under an orbit of a railroad and a river or the like and a pipe can be buried while preserving the environment, and further, the non-drive construction method is a short construction schedule. Further, according to the drive construction method, a so-called power shovel or the like is used; however, according to the non-drive construction method, a horizontal drill is used. This horizontal drill has a two process system including a pilot excavation, enlargement of a diameter, and retracting a buried pipe, and the present invention relates to a reamer apparatus which is used for a ground boring machine to be used in this two process system.

In the case of burying a buried pipe with a horizontal drill construction, as shown in FIG. 9, at first, a penetration pit P1, a starting pit P2, and an attainment pit P3 are formed on the earth at certain intervals each other. In the vicinity of the penetration pit P1, a drilling fluid feeder 101 and a drill driving device 102 (constructing a horizontal drill) are disposed. Then, a buried pipe 104 is disposed in the vicinity of the attainment pit P3, of which length approximately equivalents to a distance from the starting pit P2 to the attainment pit P3. This is a preparation operation. In the meantime, the drill driving device 102 is defined to be freely promote in the earth as adding a plurality of hollow rods 105, and further, on the contrary, the drill driving device 102 is defined to be freely pulled out from the earth as adding a plurality of hollow rods 105. The drilling fluid feeder 101 stores a drilling fluid such as a crystal water, a muddy water, a bentonite muddy water or the like therein and at the same time, the drilling fluid feeder 101 can freely pressure feed the stored drilling fluid into a hollow of the hollow rod 105 which is disposed on the drill driving device 102 via a hose 107.

Therefore, on the drill driving device 102, the first hollow rod 105 is installed to be supported. At a front end of this hollow rod 105, for example, a leading body (a pilot head) 105*a* with an outer diameter of about 70 to 100 mm is fit in advance. In the meantime, for example, an outer diameter of the hollow rod 105 is about 40 to 50 mm. Then, by means of the drill driving device 102, the first hollow rod 105 penetrates through the penetration pit P1 obliquely at a penetration angle β (nearly equal to 15°) if the earth is approximately horizontal; the first hollow rod 105 is promoted in an arrow direction A1 toward the starting pit P2 without no rotation while rotating the hollow rod 105; and bending it horizontally, a pilot hole 108 is formed in the starting pit P2. Further, as adding the hollow rods 105 to the attainment pit P3 via the starting pit P2, the hollow rods 105 are promoted in the earth in an arrow direction A2.

In other words, in the case of drilling and making a linear hole, while rotating the oblique leading body 105*a* that is fit to this rod front end by means of a rotational motor 130 of the drill driving device 102 via the rod 105, the rotational motor 130 is promoted along a frame 131. In addition, in the case of changing a direction (in the case of drilling and making a curved hole), the rotational motor 130 is not rotated but stopped, and under this state, the rotational motor 130 is promoted along the frame 131 (the rod 105 is promoted). Then, making an obliquely-cut surface of the oblique leading body 105*a* to act on the earth pressure, the direction of the oblique leading body 105*a* is changed to the opposite direction of the oblique-cut surface to be promoted. Thus, by promoting the rod 105, the curved hole is drilled so that the oblique leading body 105*a* attains to the attainment pit P3. In the meantime, the pilot head 105*a* has a plurality of nozzle holes (illustration thereof is omitted) communicating through the hollow of the hollow rod 105. Therefore, upon promoting the pilot head, the drilling fluid that is pressure-fed from the drilling fluid feeder 101 is emitted backward so as to discharge the drilling fluid and the drilled earth and sand backward.

Then, when the leading body (the pilot head) 105*a* protrudes in the attainment pit P3, the pilot hole 108 is completed. Then, the pilot head 105*a* is removed. Then, a reamer apparatus provided with a reamer (a diameter enlarging device) is fit, which reamer has a diameter approximately identical with or slightly larger than a pipe diameter of the buried pipe 104.

A conventionally known reamer of a reamer apparatus was a conical one, of so-called spindle type, that corresponds to pebbles and gravel-containing soil (see, for example, JP-A 9-195678(1997) (Pages 3 to 5, FIG. 1)). In this case, a reamer 109 of a reamer apparatus is connected to a rod 105 by being screwed to the rod 105 as shown in FIG. 11, and the reamer 109 is connected to the buried pipe 104 through a coupling member 110. More particularly, a coupling tool 112 is connected to a coupling piece 111 at a rear end of the reamer whereupon the reamer 109 is coupled with a ground drawing jig 113, and a coupling tool 116 is connected to a coupling piece 115 that is provided at a tip end of a welding cup 114 whereupon the ground drawing jig 113 is connected to the welding cup 114 and the welding cup 114 is welded with the buried pipe 104.

Thus, after fitting the reamer apparatus between the hollow road 105 and the buried pipe 104, the hollow rod 105 is retracted into a direction of an arrow B2 shown in FIG. 11 while rotating the hollow rod 105 by means of the drill driving device 102. The earth and sand generated in this time is discharged from a space between the pilot hole 108 and an outer diameter of the rod by emitting the drilling fluid. In addition, a part of the drilling fluid of the reamer apparatus comes round to a rear side to carry out a roll of a lubricant for the buried pipe 104. Then, the cut earth is confined in an inner wall of a hole at an outer periphery of the reamer 109 by rotation with respect to the pilot hole 108 and retracting of the reamer 109, and thereby, the diameter of the pilot hole 108 is enlarged and the buried pipe 104 is retracted in the enlarged hole to be formed along the direction of the arrow B1. Thus, the above-described drilling fluid is used for discharging the drilled earth and sand, lubrication and cooling of the oblique leading body (pilot head) 105*a* or the reamer 109, and smooth promotion of the rod 105, and further, the bentonite fluid is used for preventing the earth and sand from falling in a drilled hole and improving a pressure density for the wall of the drilled hole.

Then, when the hollow rod 105 is retracted till the front end of the buried pipe 104 protrudes in the starting pit P2, it is possible to set the buried pipe 104 between the attainment pit P3 and the starting pit P2 if the reamer device is detached from the buried pipe 104 and the hollow rod 105 in the starting pit P2. Then, the hollow rod 105 is pulled out from the penetration pit P1. In addition, when the buried pipe 104 is buried for a long distance, the pipe burying operation in the above-described series of processes will be repeated.

In the reamer apparatus of the above publication, the reamer 109 is connected to the buried pipe 104 through a coupling member 110, and a clearance portion (concave portions in the peripheral direction) 117 is formed between the ground drawing jig 113 and a rearward side of the reamer 109. It may therefore happen that sediments that cannot be discharged to the rod side or sediments that are not compressed against the hole inner wall enter this clearance portion 107, and in the presence of such intrusion, the drawing resistance when drawing the buried pipe 104 will become large so that a large drawing force is required. Through such intrusion of sediments to the clearance portion 117, it would happen that an attraction force that is larger than normal drawing force for a buried pipe 104 was required or that the flexibility of the reamer 109 was degraded so that the steerability of drawing of the buried pipe 104 was degraded, and there was the fear that no stable burying operations could be performed. Moreover, there also exists the danger that sediments would intrude and damage a Swivel joint portion, and due to the fact that the used ground drawing jig 113 was of long dimension, the length dimension of the coupling member 110 became accordingly large to thereby degrade the flexibility. Due to the large length dimension of the coupling member 110, the length dimension of a ground aperture hole P2 (reamer connecting hole) became also large so that the degree of so-called overbreak was increased which, in turn, caused increased construction time (operating time).

In FIG. 11, a cover member 118 is provided at the ground drawing jig 113 on the side of the buried pipe, wherein the cover member 118 encompasses a coupling tool 116 for connecting the ground drawing jig 113 and the buried pipe 104, and by providing a similar cover member 120 at the ground drawing jig 113 on the reamer 109 side, it may encompass a coupling tool 112 that connects the ground drawing jig 113 and the reamer 109. However, since the ground drawing jig 113 needs to be bent with respect to the reamer 109, it is necessary to provide a clearance between the cover member 120 and the reamer 109. At this time, since the driving direction is a direction towards the rod 105, sediments will intrude from between this clearance, wherein such sediments were hardly discharged after once intruding into the clearances so that it was feared that the Swivel joint portion was damaged.

SUMMARY OF THE INVENTION

The present invention has been made to solve the above drawbacks of the prior art, and it is an object thereof to provide a reamer apparatus for a ground boring machine that is capable of restricting increase in drawing resistance when performing drawing of the buried pipe by using a reamer and of efficiently performing drawing operations of the buried pipe without degrading the flexibility and rotatability.

According to a first aspect of the present invention, a reamer apparatus for a ground boring machine includes a substantially hollow conical reamer main body 8 which diameter reduces towards a drawing side, a rod connecting portion 24 provided at a narrow diameter end portion of the reamer main body 8 and connected with a rod 3, and a coupling structure 7 provided on an opposite side of the rod connecting portion 24, wherein the coupling structure 7 has a Swivel joint 34 that allows rotation of the reamer main body 8 with respect to the buried pipe 1, and a main portion of the Swivel joint 34 is substantially accumulated in the reamer main body 8.

According to the reamer apparatus for a ground boring machine of the first aspect, the main portion of the Swivel joint 34 of the coupling structure 7 is substantially accumulated within the reamer main body 8 so that intrusion of sediments to the Swivel joint 34 can be prevented even in the presence of sediments that are not compressed against hall inner walls. More particularly, when burying a buried pipe 1 by using this reamer apparatus, the buried pipe 1 is drawn into a pilot hole 5 that has been preliminarily formed in the ground, wherein the rod 3 is connected to the rod connecting portion 24 whereupon the rod 3 is drawn out from the pilot hole 5, and the narrow diameter side of the reamer main body 8 will be a progressing direction. Sediments will thus flow from the small diameter (narrow diameter) side to the large diameter side, that is, rearward with respect to the reamer main body 8 so that it is possible to prevent intrusion of sediments to the Swivel joint 34 which main portion is substantially accumulated in the reamer main body 8. It is accordingly possible to prevent the Swivel joint 34 from being damaged, and the reamer main body 8 may be smoothly rotated so that diameter expanding operations of the reamer main body 8 can be performed in a stable manner. Since the main portion of the Swivel joint 34 is substantially accumulated in the reamer main body 8, it is possible to decrease a spatial dimension between the buried pipe 1 and the reamer main body 8 so as to improve the flexibility of the reamer main body 8 with respect to the buried pipe 1 and thus to improve the drawability of the buried pipe 1. Moreover, when the spatial dimension between the buried pipe 1 and the reamer main body 8 becomes small, it is possible to reduce the overbreak (reamer connecting hole) opening to the ground so as to achieve saving of construction time while also preventing increase in drawing resistance.

In a reamer apparatus for a ground boring machine according to a second aspect of the present invention, the Swivel joint 34 is arranged in that a rotating side on the reamer main body 8 side and a non-rotating side on the side of the buried pipe 1 are sealed by a floating seal 57.

Since the Swivel joint 34 in the reamer apparatus according to the second aspect is arranged in that the rotating side on the reamer main body side 8 and the non-rotating side on the side of the buried pipe 1 are sealed by the floating seal 57, it is possible to comprise a mechanism for preventing intrusion of sediments exhibiting superior reliability and durability over a long period of time. It is therefore possible to achieve elongation of maintenance intervals.

According to a third aspect of the present invention, a reamer apparatus for a ground boring machine includes a substantially hollow conical reamer main body 8 which diameter reduces towards a drawing side, a rod connecting portion 24 provided at a narrow diameter end portion of the reamer main body 8 and connected with a rod 3, a coupling structure 7 provided on an opposite side of the rod connecting portion 24, wherein a cover 74 for preventing intrusion of sediments is attached to the reamer main body 8 to encompass an outer peripheral side of the coupling structure 7 by the cover 74 for preventing intrusion of sediments while a clearance 79 is formed between an end portion of the cover 74 for preventing intrusion of sediments on a side that is opposite to the reamer main body side and the buried pipe 1.

According to the reamer apparatus for a ground boring machine of the third aspect, the cover 74 for preventing intrusion of sediments that is mounted to the reamer main body 8 is provided between the reamer main body 8 and the buried pipe 1, so that it is possible to prevent intrusion of sediments to between the reamer main body 8 and the buried pipe 1 and to avoid increase in drawing resistance of the buried pipe 1 through intrusion of sediments into the reamer apparatus. With this arrangement, it is possible to perform drawing operations of the buried pipe 1 in a light manner without the necessity of performing the same at excessive drawing force. It is further possible to prevent damages of the coupling structure 7 through intrusion of sediments, and diameter expanding operations can be performed in a stable manner. Moreover, by the provision of the clearance 79 between the end portion on the side opposite to the reamer main body side and the buried pipe 1, it is possible to secure flexibility of the reamer 6 with respect to the buried pipe 1. When performing drawing operations, sediments will flow towards the side of the buried pipe 1 with respect to the reamer apparatus, so that it is possible to prevent intrusion of sediments from the clearance 79 between the cover 74 for preventing intrusion of sediments and the buried pipe 1.

In a reamer apparatus for a ground boring machine according to a fourth aspect of the present invention, the cover 74 for preventing intrusion of sediments is arranged in that an end portion thereof on the reamer main body 8 side is plunged into the reamer main body 8.

In the reamer apparatus for a ground boring machine according to the fourth aspect, an end portion of the cover 74 for preventing intrusion of sediments on the reamer main body 8 side is plunged into the reamer main body 8, so that it is possible to further prevent intrusion of sediments from the end portion of the cover 74 for preventing intrusion of sediments on the reamer main body 8 side to the coupling structure 7 side.

According to a fifth aspect of the present invention, a reamer apparatus for a ground boring machine includes a substantially hollow conical reamer main body 8 which diameter reduces towards a drawing side, wherein a partitioning member 22 is disposed in the vicinity of an aperture of the reamer main body 8 on a side of a buried pipe 1, a passage is formed within the reamer main body 8 through which drilling fluid is supplied for injecting the drilling fluid to a portion to be drilled through emission ports 15, and an injection tip 36 is provided at the partitioning member 22 through which the drilling fluid that has entered the passage is discharged to the side of the buried pipe 1.

In the reamer apparatus for a ground boring machine according to the fifth aspect, the partitioning member 22 is disposed in the vicinity of the aperture of the reamer main body 8 on the side of the buried pipe 1, so that the reamer main body 8 is reinforced by the partitioning member 22 and thus exhibits favorable strength, and it is possible to perform diameter expanding operations of the pilot hole 5 in a stable manner. Moreover, by providing the injection tip 36 at the partitioning member 22 for discharging the drilling fluid that has entered the passage to the side of the buried pipe 1, it is possible to prevent sediments from remaining in the rearward side of the reamer main body 8 by the drilling liquid injected from the injection tip 36, and to prevent increases in drawing resistance of pipes to be buried through intrusion of sediments into the reamer apparatus. It is also possible to pour washing water from the injection tip 36 or emission ports 15 after completion of burying operations for washing the interior of the passage. Therefore, even if clogging of the injection tip 36 or the emission ports 15 should happen when performing burying operations, it is possible to eliminate such clogging, and cutting and breaking actions of soil can be effectively exhibited during the next burying operations using the reamer apparatus. In this respect, when the reamer apparatus according to the fifth aspect is provided with the cover 74 for preventing intrusion of sediments as that of the reamer apparatus according to the third aspect, the injection tip 36 may be provided either on the outer diameter (outer) side of the cover 74 or on the inner diameter (inner) side thereof. When the injection tip 36 is provided on the outer diameter side of the cover, the drilling fluid that is discharged from the passage will be discharged rearward without entering the cover, and sediments outside of the cover are made to flow rearward. When the injection tip 36 is provided on the inner diameter side of the cover, a rearward flow of drilling fluid is caused within the cover, and sediments that have entered the cover 74 can be discharged from the rear clearance 79.

DESCRIPTION OF THE PREFERRED EMBODIMENTS

Figure 1:
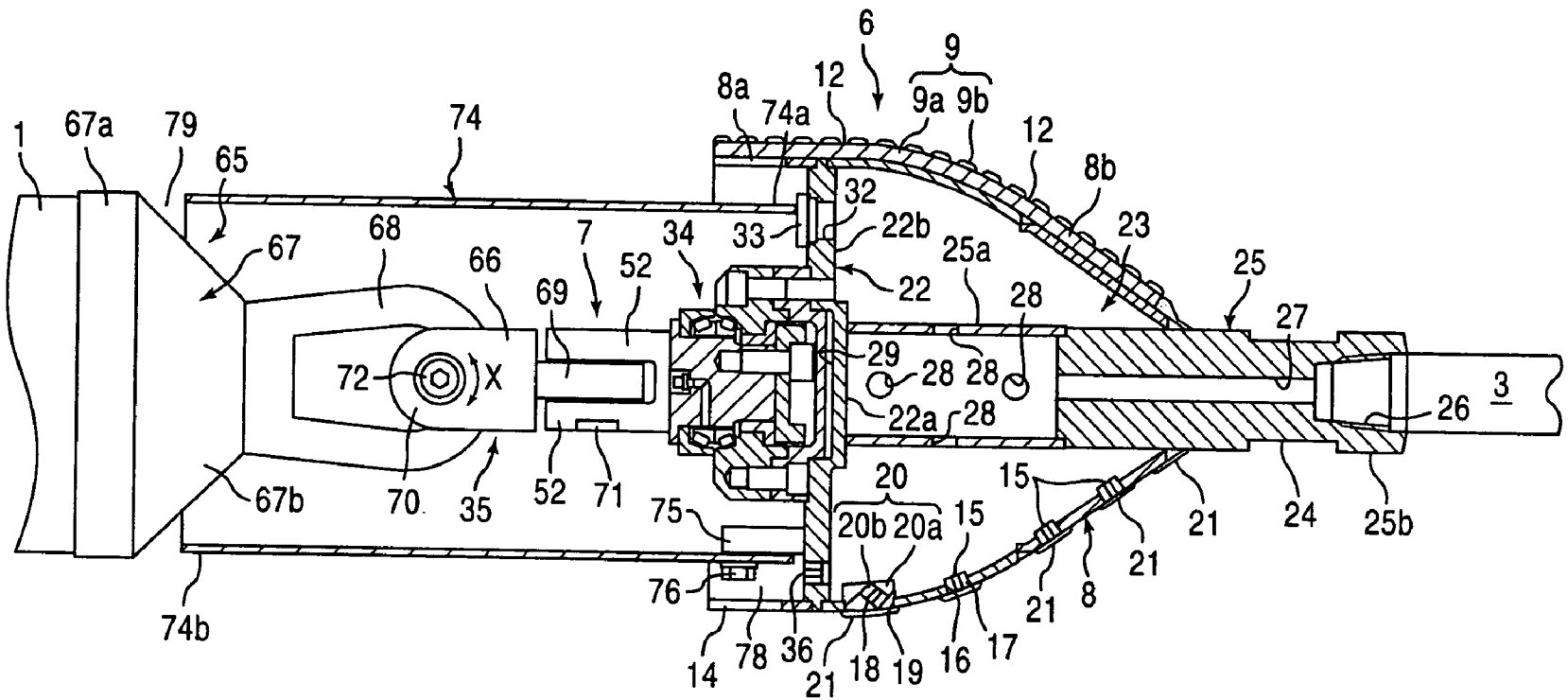
FIG. 1 is a sectional view showing an embodiment of a reamer apparatus for a ground boring machine according to the present invention.
Figure 2:
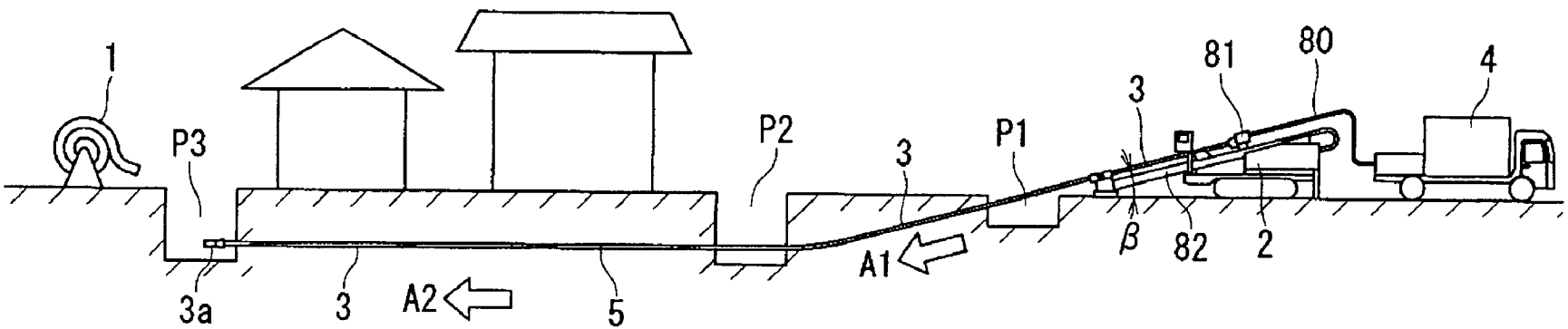
FIG. 2 is a simplified view showing a method for forming a pilot hole by the ground boring machine.
Figure 3:
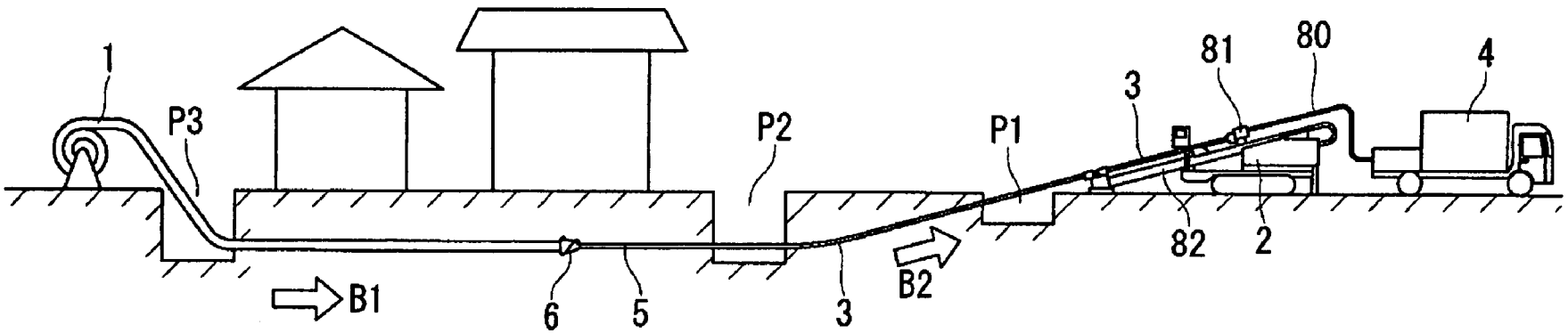
FIG. 3 is a simplified view showing a method for burying a buried pipe by the ground boring machine.
Figure 9:
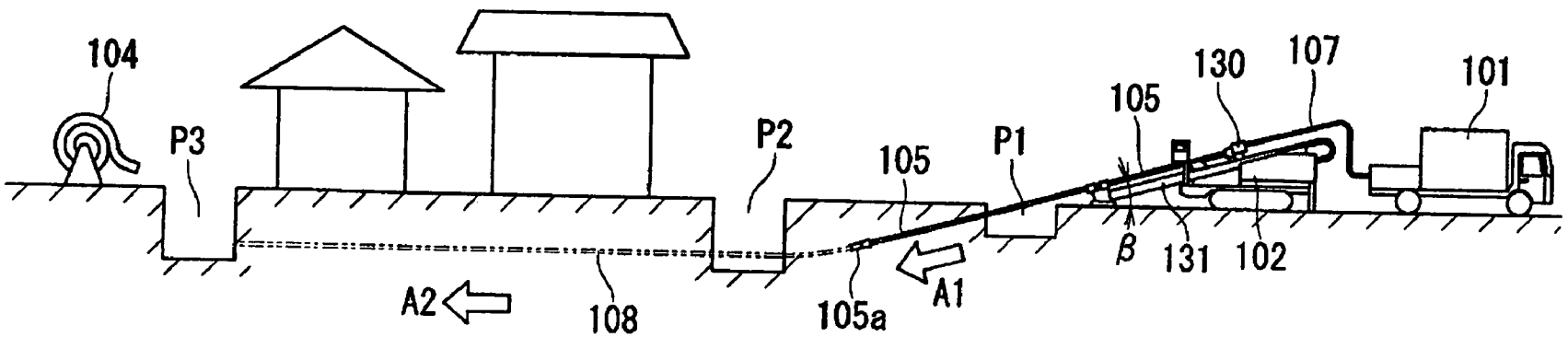
FIG. 9 PRIOR ART
FIG. 9 is a simplified view showing a method for forming a pilot hole by the ground boring machine.
Figure 10:
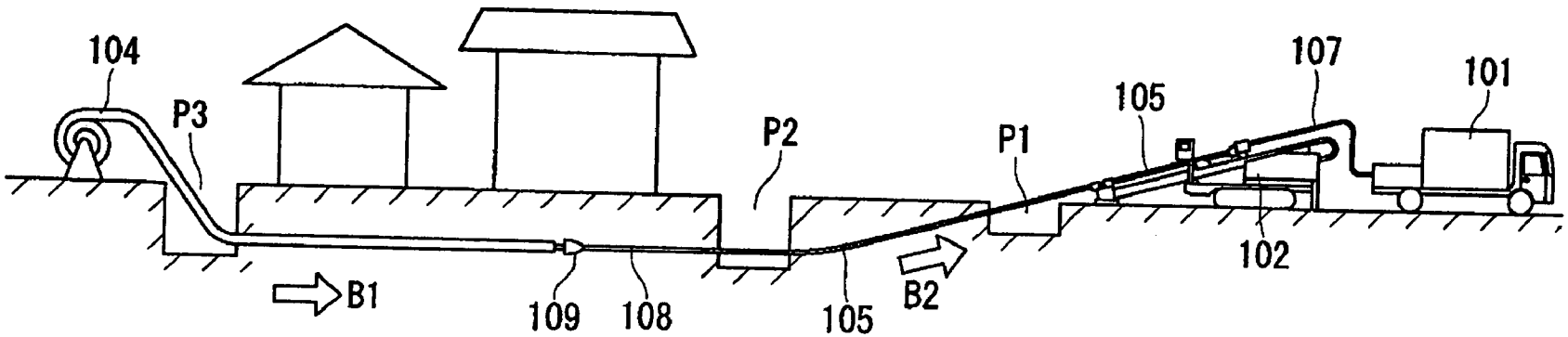
FIG. 10 PRIOR ART
FIG. 10 is a simplified view showing a method for burying a buried pipe by the ground boring machine.
Figure 11:
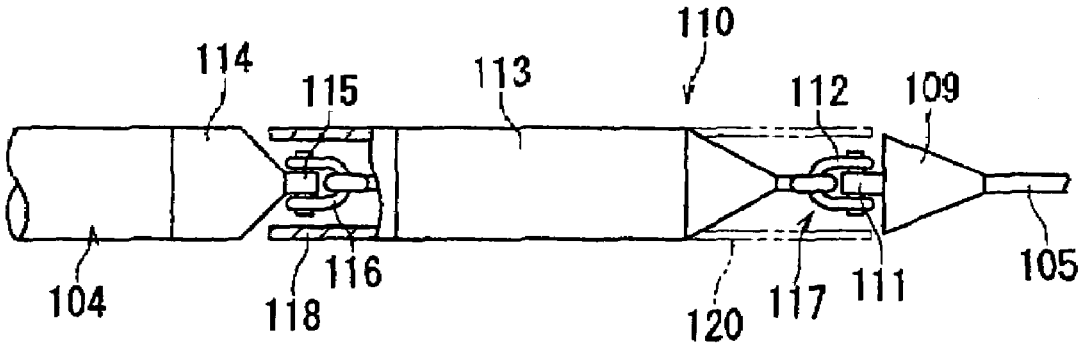
FIG. 11 PRIOR ART
FIG. 11 is a simplified view showing a conventional reamer apparatus for a ground boring machine.

A concrete embodiment of the reamer apparatus for a ground boring machine of the present invention will now be explained in details while referring to the drawings. FIG. 1 illustrates a sectional view of the reamer apparatus, wherein the reamer apparatus is used for a ground boring machine that is used in the above-described horizontal drilling. The ground boring machine may be comprised by a drill driving device 2 and a drilling fluid feeder 4. While operations of burying a buried pipe 1 by using the ground boring machine are performed through operations as shown in FIGS. 9 and 10, such operations will be briefly explained by using FIGS. 2 and 3. As first shown in FIG. 2, a penetration pit P1, a starting pit P2, and an attainment pit P3 are provided on the ground surface to be separate from each other by specified distances. A rod (hollow rod) 3 mounted with a lead body (pilot head) 3*a* at its tip end is provided and supported on the drill driving device 2. While drilling fluid (clear water, mud water, bentonite mud water or the like) that is press-fed from the drilling fluid feeder 4 is injected from the lead body 3*a*, the rod 3 is penetrated by the drill driving device 2 in an oblique manner with respect to the penetration pit P1 at a penetration angle β (for example, about 15°) when the ground is substantially horizontal, and the hollow rod 3 is driven in a direction of the arrow A1 towards the starting pit P2 while rotating the hollow rod 3, then driven without being rotated and bent horizontally for forming a pilot hole 5 in the starting pit P2. The hollow rods 3 are joined upon further passing the starting pit P2 to the attainment pit P3 so as to drive in a direction of the arrow A2 through the ground. More particularly, when a straight hole is to be drilled and formed, the lead body (diagonally cut lead body) 3*a*, which is mounted to a tip end of the rod, is rotated through the rod 3 by a rotating motor 81 of the drill driving device 2 so as to drive the rotating motor 81 along a frame 82. When changing directions (when a curved hole is to be drilled and formed), the rotating motor 81 is not rotated but terminated whereupon the rotating motor is driven along the frame 82 in this condition (the rod 3 is driven) for making a diagonally cut surface of the diagonally cut lead body 3*a* act onto earth pressure, so that the direction is changed to an opposite direction of the diagonally cut surface and driven. In this respect, the pilot head 3*a* includes a plurality of nozzle holes (not shown) communicating into the hollow of the hollow rod 3. When driving the pilot head, the drilling fluid that has been pressure-fed from the drilling fluid feeder 4 is injected rearward for making the drilling fluid and the excavated sediments flow out in a rearward direction.

When the lead body (pilot head) 3*a* projects into the attainment pit P3, the pilot hole 5 is completed. The pilot head 3*a* is then detached. A reamer apparatus provided with a reamer 6 (diameter expanding tool) having a diameter that is substantially identical or somewhat larger than the pipe diameter of the buried pipe 1 is then mounted. After mounting the reamer apparatus, the hollow rod 3 is drawn into a direction of arrow B2 in FIG. 3 while rotating the hollow rod 3 by the drill driving device 2. At this time, the sediments that have then been generated are discharged (excavated) through injection of the drilling fluid from between a space between the pilot hole 5 and the outer diameter of the rod. A part of the drilling fluid moves rearward to serve as a lubricating fluid with respect to the buried pipe 1. The cut and broken soil is compressed against hole inner wall of an outer periphery of the reamer 6 through rotation with respect to the pilot hole 5 and drawing of the reamer 6, whereby the pilot hole 5 is expanded in diameter, and the buried pipe 1 is drawn into the thus formed expanded hole along a direction of arrow B1.

Figure 4:
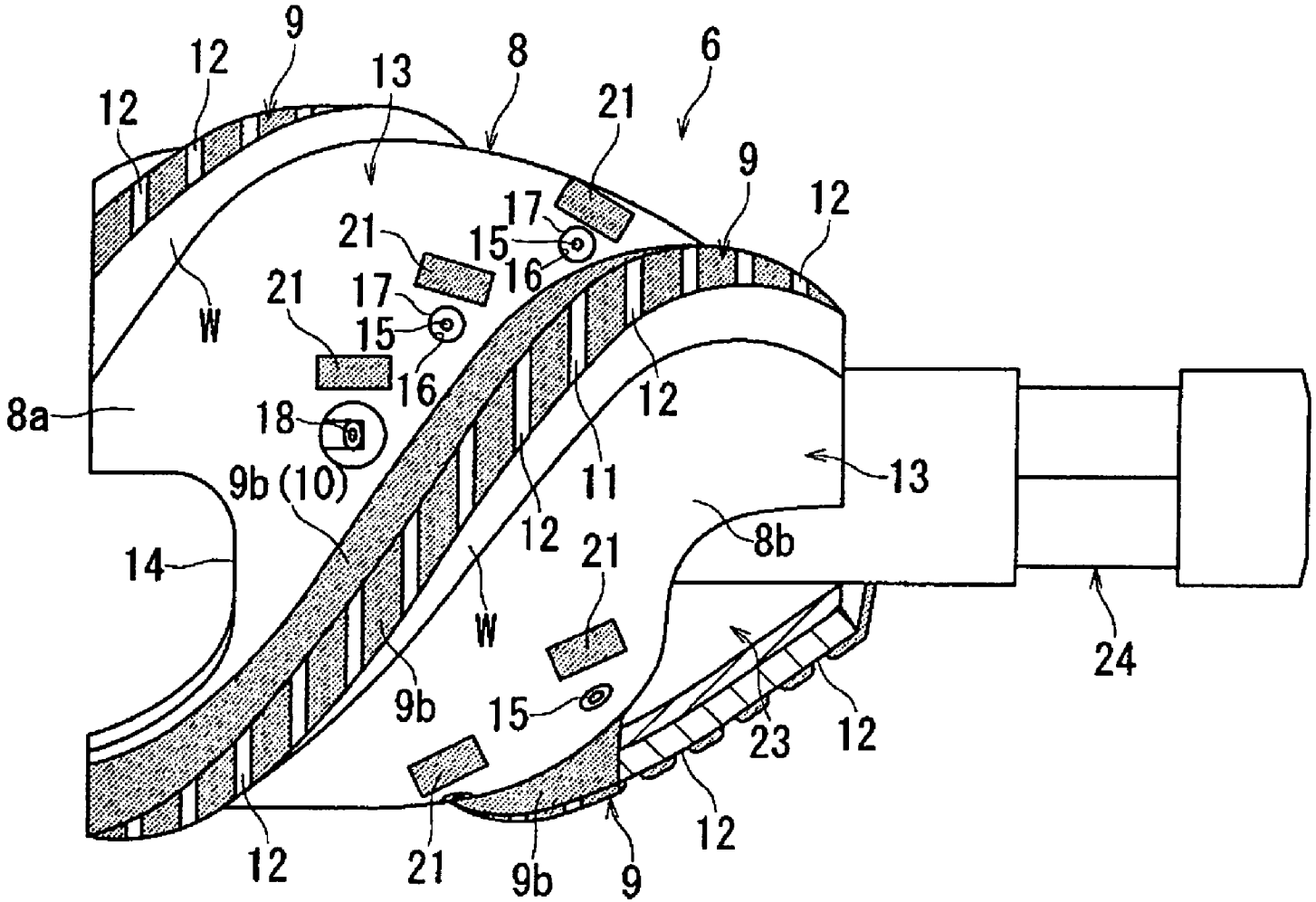
FIG. 4 is a side view showing a reamer of the reamer apparatus.
Figure 5:
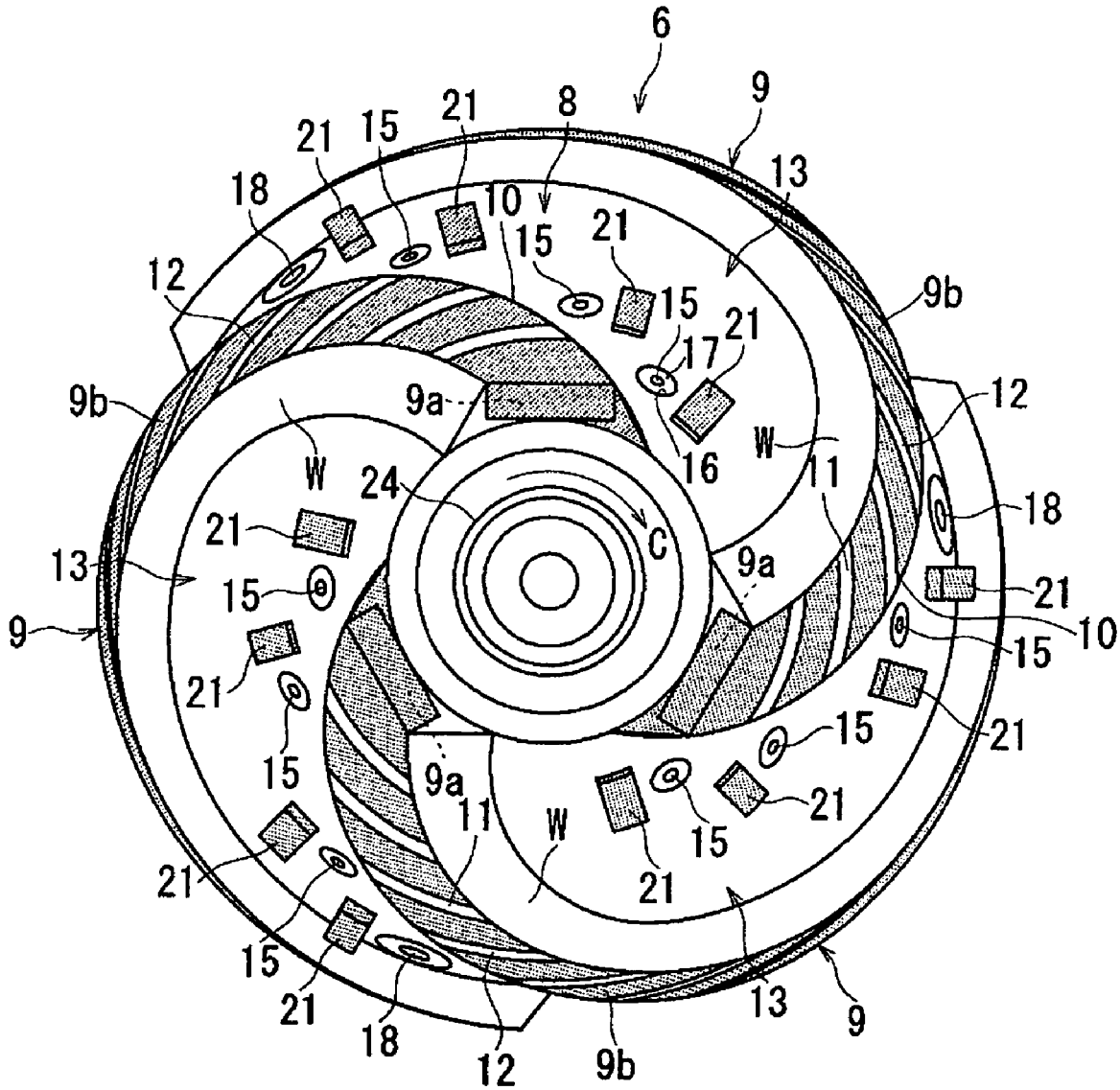
FIG. 5 is a front view showing the reamer of the reamer apparatus.
Figure 7:
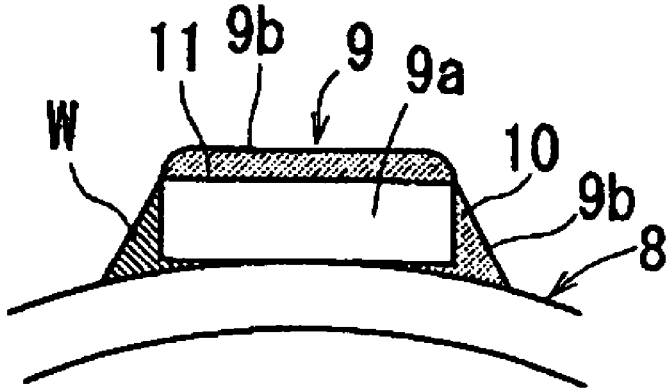
FIG. 7 is a sectional view of the reamer of the reamer apparatus with a main portion thereof being enlarged.

The reamer apparatus will now be explained. As shown in FIGS. 1, 4 and 5, the reamer apparatus comprises the reamer 6, and the reamer 6 is connected to the buried pipe 1 with a coupling structure 7 being interposed between. The reamer 6 comprises a substantially hollow conical shaped reamer main body 8 which diameter reduces towards a drawing side and a plurality of platy members 9 that are fixedly attached to an outer surface of the reamer main body 8. In this respect, the reamer main body 8 is referred to as having a substantially hollow conical shape not only when it is of accurate conical shape but also in case it is comprised of a short cylindrical base end body 8*a* and a front end taper portion 8*b* as shown in FIG. 1 and others, in case a rod connecting portion 24 as will be described later is provided at the tip end portion in a projecting manner, or in case a build-in member (a Swivel joint 34 as will be described later) is accumulated in the interior. As shown in FIG. 7, each platy member 9 is comprised of a platy member main body 9*a* and a curing processing part 9*b* that is provided on an outer surface of the platy member main body 9*a*. The platy member 9 is disposed at the reamer main body 8 from its tip end portion to its base end portion to be inclined with respect to the central axis of the reamer main body 8 at a specified angle. In this case, the platy members 9 are fixedly attached to the reamer main body 8 through welding and are disposed in a spiral manner.

The curing processing part 9*b* is formed by carbide particle dispersion. In this respect, the carbide particles used may be a sinter with its main component being, for example, tungsten carbide, which is a high melting point metal. In this case, while the curing processing part 9*b* is provided on a cutting blade 10 side of the platy member main body 9*a* and on an outer surface 11 of the platy member main body 9*a* as shown in FIG. 7 since the platy member 9 comprises the drilling portion, it is possible to provide it only on the cutting blade 10 side or on the outer surface 11 side. As shown in FIG. 4 and others, cutout parts 12 are provided in a peripheral direction at specified pitches along the longitudinal direction of the platy member 9 on the curing processing part 9*b* on the outer surface 11. The cutout parts 12 comprise grooves (spaces) through which sediments escape when performing drilling so as to achieve reductions in friction coefficient. The drilling portion may alternatively not include the platy member main body 9*a* as long as it projects out from the outer surface of the reamer main body 8. More particularly, the drilling portion may be comprised by the curing processing part 9*b* alone by burying, for example, carbide chips or similar onto the outer surface of the reamer main body 8. In this respect, W indicate welding portions that are provided on the cutting blade 10 and the opposite side thereof in FIGS. 4, 5 and others.

By fixedly attaching a plurality of platy members 9 to the reamer main body 8, concave grooves 13 will be formed between respective platy members 9, 9. The concave grooves 13 comprise discharge grooves for excavated soil. Notched portions 14 are provided at a rear end edge portion of each concave groove 13. The notched portions 14 serve to discharge sediments that have entered the concave grooves 13 in a rearward direction.

A plurality of emission ports 15 through which drilling fluid is injected is disposed along the platy members 9 within the concave grooves 13. In this case, screw holes 16 are provided on a peripheral wall of the reamer main body 8 while nozzle members 17 are fitted and attached to the screw holes 16. Through holes of the nozzle members 17 (through holes provided in a direction that is substantially orthogonal to the peripheral wall of the reamer main body 8) comprise the emission ports 15.

As stated above, the reamer main body 8 is comprised of the base end body portion 8*a* and the tapered tip end portion 8*b*, wherein the notched portions 14 are formed at the base end body portion 8*a* and the emission ports 15 at the tapered tip end portion 8*b*. A discharge port 18 for discharging the drilling fluid to obliquely rearward is provided at the tapered tip end portion 8*b* on the base end body portion 8*a* side. In this case, a penetration hole 19 is provided at the peripheral wall of the reamer main body 8 wherein a nozzle member 20 is fitted and attached to the penetration hole 19. The nozzle member 20 is comprised of a block body 20*a* and a nozzle 20*b* that is screwed to the block member 20*a*.

Projection members 21 are disposed in the vicinity of the respective emission ports 15 and the discharge port 18 so as to prevent intrusion of excavated sediments thereto. In this case, the projection members 21 are formed on the frontward side of the reamer 6 in rotating direction C (see FIG. 5). Each projection member 21 is preferably formed with a curing processing part formed through carbide particle dispersion on the surface thereof. More particularly, similarly to the curing processing part 9*b* of the platy member 9, a projection member main body that has not undergone hardening shall be fixedly attached (welded) to the reamer main body 8 whereupon the curing processing part shall be formed on the surface of this main body. In this respect, it is alternatively possible to form the projection members 21 through so-called padding of carbide or burying of carbide chips without using such a main body.

As shown in FIG. 1, a disk-like partitioning member 22 is attached to the reamer main body 8 an aperture portion side of large diameter. With this arrangement, a hollow chamber 23 is formed in the reamer main body 8 as a passage through which the drilling fluid is supplied. A shaft member 25 that comprises a rod connecting portion 24 (that is provided at the narrow diameter end portion of the reamer main body 8) to which the rod 3 is connected is fixedly attached to the partitioning member 22. The shaft member 25 is comprised of a cylinder part 25*a* that is provided to project from the partitioning member 22 and a shaft portion 25*b* that is provided to project from the cylinder part 25*a*, wherein a screw hole 26 is provided on an end surface of the shaft portion 25*b* while a through hole 27 that opens from the screw hole 26 to the cylinder part 25*a* is formed. A plurality of penetration holes 28 is formed at the cylinder part 25*a*. In this case, the partitioning member 22 is comprised, at its central axis portion, with a central portion 22*a* including a concave portion 29 on the side of the buried pipe and brim portion 22*b* that extends from the central portion 22*a* in an outer diameter direction, and the cylinder part 25*a* is provided to project from the rod side of the central portion 22*a*.

A screw portion (not shown) at a tip end of the rod 3 is screwed to the screw hole 26 of the shaft portion 25*b* and the reamer 6 is mounted to the rod 3. Drilling fluid that has been supplied from the drilling fluid feeder 4 to the rod 3 enters the cylinder part 25*a* through the through hole 27 of the shaft portion 25*b* and is supplied from the cylinder part 25*a* to the hollow chamber 23 through the penetration holes 28. The drilling fluid that has entered the hollow chamber 23 is discharged to the exterior through the respective emission ports 15 and the drain emission port 18. In this respect, since the hollow chamber 23 serves as a passage for supplying the drilling fluid to the respective emission ports 15 and the drain emission port 18, it is also possible to form such a passage through a piping. Moreover, while the rod connecting portion 24 has been comprised by the shaft portion 25*b* that projects from the narrow diameter end portion of the reamer main body 8, it may alternatively been arranged not to project from the narrow diameter end portion of the reamer main body 8. That is, a screw hole portion into which the end portion of the rod 3 is screwed shall be formed within the narrow diameter end portion of the reamer main body 8.

Figure 8:
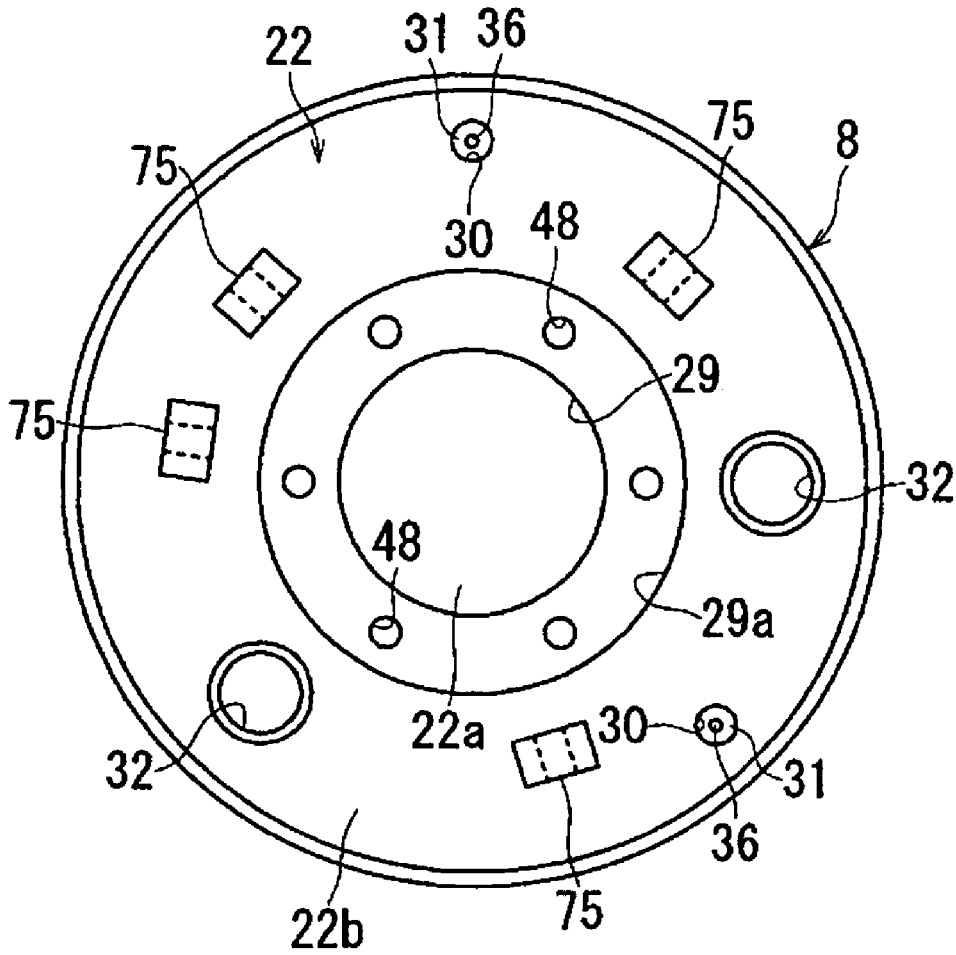
FIG. 8 is a rear view of a reamer main body of the reamer apparatus.

As shown in FIG. 8, the partitioning member 22 is provided with injection tips 36 for discharging the drilling fluid that has entered the hollow chamber 23 to the side of the buried pipe (rearward side). In this case, a screw hole 30 is provided at the partitioning member 22 to which screw hole 30 the nozzle member 31 is fitted. Through holes of the nozzle members 31 comprise the injection tips 36. The partitioning member 22 is provided with cleaning holes 32 for cleaning the interior of the hollow chamber 23 after using the reamer 6 and other occasions. In this case, the cleaning holes 32 are comprised of screw holes, and stopper members 33 (see FIG. 1) are attached thereto in a normal condition of use. In this respect, while two injection tips 36 and cleaning holes 32 are respectively provided in this embodiment, the present invention is not limited to this.

Figure 6:
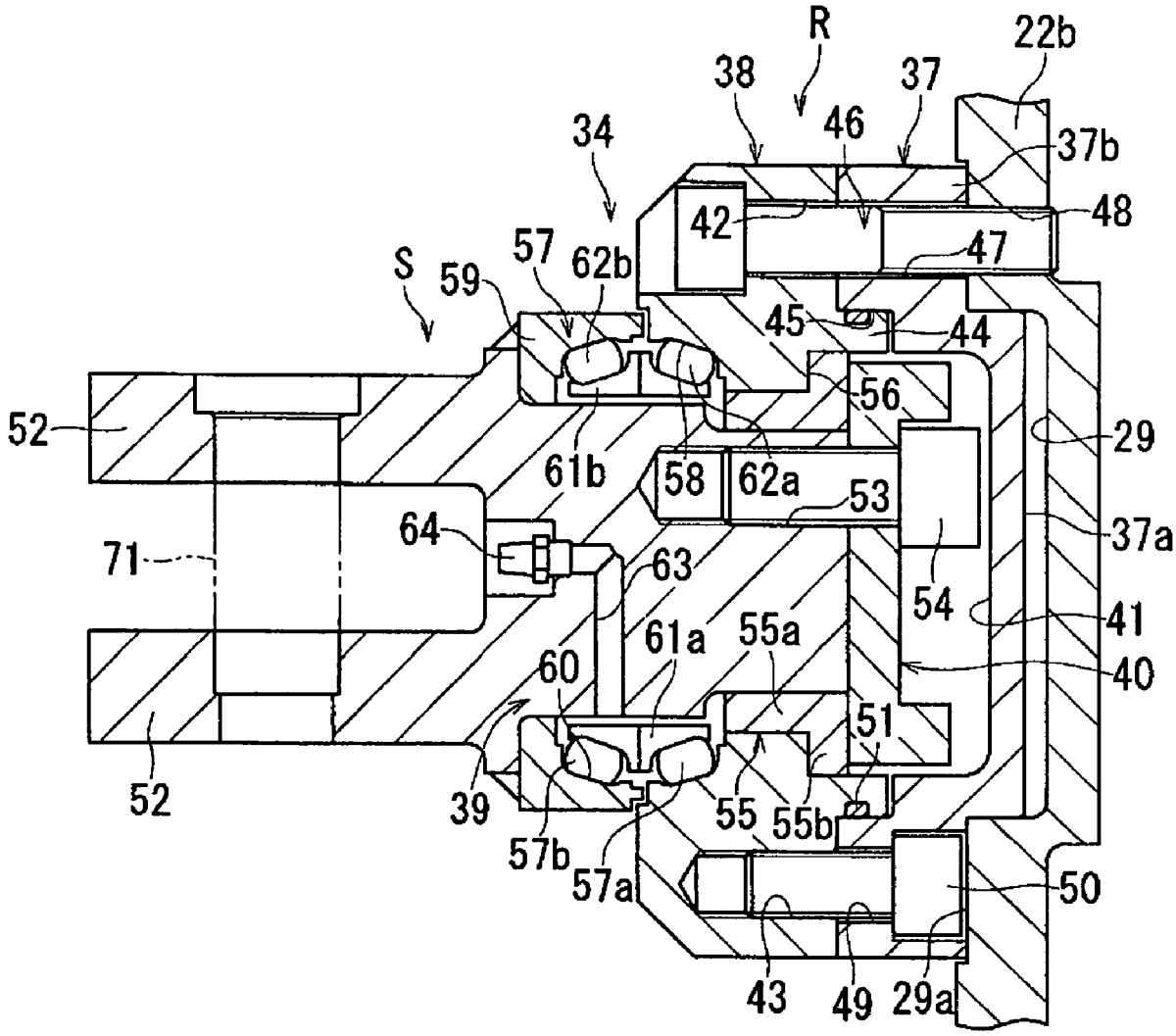
FIG. 6 is a sectional view of the reamer apparatus with a main portion thereof being enlarged.

As shown in FIG. 1, the coupling structure 7 that connects the reamer main body 8 of the reamer 6 and the buried pipe 1 is comprised with a Swivel joint 34 and a connecting tool 35 that connects the Swivel joint 34 and the buried pipe 1. As shown in FIG. 6, the Swivel joint 34 is comprised of a non-rotating side member S and a rotating side member R, wherein the non-rotating side member S includes a shaft portion 39 and a push plate 40 that is fixedly attached to the shaft portion 39 while the rotating side member R includes a base portion 37 that is fixedly attached to the portioning member 22 and a block body 38 that is fixedly attached to the base portion 37.

The base portion 37 is comprised of a main body portion 37*a* including a concave portion 41 and a brim portion 37*b* that extends in the outer diameter direction from the main body portion 37*a*, wherein the brim portion 37*b* fits into a fitting concave 29*a* of the brim portion 22*b* of the partitioning member 22 while the main body portion 37*a* is in a condition in which it is fitted to the concave portion 29 of the partitioning member 22. The block body 38 is comprised of a ring body and is provided with a through hole 42 and a screw hole 43. The block body 38 is further provided with a projecting portion 44 that projects towards the base portion 37 side, wherein the projecting portion 44 is fitted into a peripheral directional notch 45 of the base portion 37, and a bolt member 46 that is inserted into the through hole 42 is inserted into a through hole 47 of the base portion 37 in this condition to be screwed into a screw hole 48 of the brim portion 22*b* of the partitioning portion 22, and a bolt member 50 that is inserted into a penetration hole 49 of the base portion 37 is screwed to the screw hole 43 of the block body 38. With this arrangement, the base portion 37 and the block body 38 are fixedly attached to the partitioning member 22. In this respect, a seal member 51 such as an O ring is fitted to another peripheral side of the projecting portion 44 of the block body 38.

A pair of projecting pieces 52, 52 are provided at a rear end side of the shaft portion 39 with screw holes 53 being provided at tip end surfaces thereof, and a bolt member 54 that is inserted into the penetration hole of push plate 40 is screwed into the screw hole 53 with the push plate 40 being in a condition in which it is abutted against the tip end surfaces. A bush 55 comprising a bearing is outwardly fitted to the shaft portion 39 on the push plate 40 side In this respect, the bush 55 is comprised of a tubular main body portion 55*a* and an outer brim portion 55*b* that projects from the tubular main body 55*a* to an outer diameter side thereof, and the outer brim portion 55*b* is fitted to the notched portion 56 of the block body 38.

The non-rotating side member S and the rotating side member R are sealed by a floating seal 57. The floating seal 57 is comprised of a first portion 57*a* on the rotating side and a second portion 57*b* on the non-rotating side. The first portion 57*a* is fitted to a fitting notched portion 58 of the block body 38 and the second portion 57*b* is fitted to a fitting notched portion 60 of a ring-like supporting body 59 that is outwardly fitted to the shaft portion 39. In this respect, the first portion 57*a* and the second portion 57*b* are comprised of seal rings 61*a*, 61*b* and O rings 62*a*, 62*b*, respectively.

The shaft portion 39 is provided with a supply path 63 through which oil is supplied to the floating seal 57, and a stopper member 64 is attached to a supply port thereof. In a condition in which the Swivel joint 34 is attached to the partitioning member 22 of the reamer main body 8, the main portion thereof (more concretely, portions except for the projecting pieces 52, 52) will be substantially accumulated in the reamer main body 8 as shown in FIG. 1.

As shown in FIG. 1, the connecting tool 35 comprises a pipe coupling 65 that is attached to an end portion of the buried pipe 1 and a joint 66 that connects the pipe coupling 65 with the Swivel joint 34. The pipe coupling 65 is comprised of a cap portion 67 that is fixedly attached to an end portion of the buried pipe 1 and a ring portion 68. More particularly, the cap portion 67 is comprised of a main body portion 67*a* and a cone portion 67*b*, wherein the ring portion 68 is provided to project from an end portion of the cone portion 67*b*. The joint 66 includes a projecting piece 69 that is inserted to between the pair of projecting pieces 52, 52 of the Swivel joint 34 and a pair of projecting pieces 70, 70 between which the ring portion 68 of the pipe coupling 65 is inserted. More particularly, a shaft portion 71 is mounted to the projecting pieces 52, 52 and the shaft portion 71 is inserted through the projecting piece 69 that is inserted between the projecting pieces 52, 52. A shaft portion 72 that is inserted through the ring portion 68 of the pipe coupling 65 is attached to the pair of projecting pieces 70, 70.

Therefore, the Swivel joint 34 is capable of rocking in a direction of arrow X around the shaft portion 72 with respect to the buried pipe 1 and of rocking in a direction that is orthogonal to the direction of arrow X around the shaft portion 71. Accordingly, the reamer 6 may be flexed with respect to the buried pipe 1 through combination of such rocking movements. The reamer 6 may of course be rotated about a central axis of the shaft member 25 by the Swivel joint 34. An outer periphery of the coupling structure 7 is encompassed by the cylindrical cover for preventing intrusion of sediments 74. In this case, a dimension of the outer diameter of the cover 74 (substantially identical to the dimension of the outer diameter of the buried pipe 1) is set to be smaller than a dimension of the inner diameter of the base end body portion 8*a* of the reamer main body 8. A plurality of supporting pieces 75 are provided at the partitioning member 22 on the side of the buried pipe 1, and one end portion (tip end portion) 74*a* of the cover 74 is made to plunge into the reamer main body 8 so as to outwardly fit the supporting pieces 75. At this time, at portions at which the one end portion 74*a* of the cover 74 overlaps with the supporting pieces 75, bolt members 76 is screwed from an outer diameter direction to attach the cover 74 to the partitioning member 22. In this respect, the bolt members 76 correspond to the notched portions 14 of the reamer main body 8 and allow screwing of the bolt members 76 from the outer diameter direction.

In a condition in which the cover 74 is attached to the partitioning member 22, annular spaces 78 are formed between the one end portion 74*a* of the cover 74 and the base end body portion 8*a* of the reamer main body 8 and the injection tips 36 open to these spaces 78. Therefore, when drilling fluid is discharged from the hollow chamber 23 of the reamer main body 8 through the injection tips 36, the fluid will be discharged rearward without entering the cover 74 and it is possible to make sediments outside of the cover flow rearward. Clearances 79 are formed between the other end portion 74*b* of the cover 74 (end portion on a side opposite to the reamer main body side) and the buried pipe 1. In this case, the clearances 79 are formed between the other end portion and the cone portion 67*b* of the cap portion 67 of the pipe coupling 65. The flexibility of the reamer 6 with respect to the buried pipe 1 will thus not be lost even though a cover 74 is provided.

The thus arranged reamer apparatus then assumes a condition as shown in FIG. 1 in which the reamer main body 8 of the reamer 6 is connected to the buried pipe 1 through the coupling structure 7 including the Swivel joint 34, and the rod 3 formed with the pilot hole 5 is connected to the rod connecting portion 24 to an tip end thereof for performing drawing operations of the rod 3. More particularly, the rod 3 is drawn in a direction of arrow B2 in FIG. 3 while rotating the rod 3 by the drill driving device 2. The sediments that are generated at this time are discharged (excavated) through injection of drilling fluid from the space between the pilot hole 5 and the rod outer diameter. Apart of the drilling fluid moves rearward for serving as a lubricant for the buried pipe 1. The cut and broken soil is compressed against the hole inner wall on the outer periphery of the reamer 6 through rotation and drawing of the reamer 6 whereby the diameter of the pilot hole 5 is increased, and the buried pipe 1 is drawn along the direction of arrow B1 into the thus formed expanded hole. When the rod 3 is drawn until the tip end of the buried pipe 1 projects into the starting pit P2, the drawing operations of the buried pipe 1 are completed.

At this time, since the reamer 6 exhibits flexibility with respect to the buried pipe 1, it is possible to draw the buried pipe 1 at stable steerability. In this respect, upon completion of such drawing processes, the reamer apparatus is detached from the buried pipe 1, the rod 3 is drawn out from the penetration pit P1, and upon reburying the respective pits P1 to P3, the pipe burying operations are completed. When the burying distance is long, the pilot hole forming operations and drawing operations of pipes to be buried 1 shall be repeated.

Similar to the emission ports 15, the discharge port 18 also injects drilling fluid and acts as a lubricant for drawing of the buried pipe 1, wherein a part of the fluid penetrates into the expanded hole and the wall of the pilot hole 5 while the remaining portions return and stay in the starting pit P2 upon passing the pilot hole 5. The remaining drilling fluid may be sucked by a suction device (not shown) and returned to the drilling fluid feeder 4 for reuse. In this manner, the drilling fluid is used for discharge of excavated sediments, for lubrication of the obliquely cut lead body (pilot head) or the reamer 6, for cooling, for smooth propulsion of the rod 3, for preventing breaking and falling of sediments to the excavated hole through a bentonite fluid, or for improving the consolidation to the drilled hall inner wall.

Since the main portion of the Swivel joint 34 of the coupling structure 7 is substantially accumulated within the reamer main body 8 in the above reamer apparatus, it is possible to prevent intrusion of sediments to the Swivel joint 34 also in the presence of sediments that are not compressed to the hole inner wall. More particularly, when drawing the buried pipe 1 into the pilot hole 5, the rod 3 is connected to the rod connecting portion 24 of the reamer 6, and by drawing out the rod 3 from the pilot hole 5, the narrow diameter side of the reamer main body 8 will be the traveling direction. The sediments will thus flow from the small diameter (narrow diameter) side to the large diameter side with respect to the reamer main body 8, that is, in a rearward direction so that it is possible to prevent intrusion of sediments to the Swivel joint 34 side which main portion is substantially accumulated in the reamer main body 8. It is therefore possible to prevent the Swivel joint 34 from being damaged, and the reamer main body 8 may smoothly rotate for stabilizing the diameter expanding operations. Since the Swivel joint 34 is substantially accumulated in the reamer main body 8, the spatial diameter between the buried pipe 1 and the reamer main body 8 can be made small so as to achieve improvements in the flexibility of the reamer 6 with respect to the buried pipe 1, and the drawability of the buried pipe 1 can be improved. Moreover, when the spatial diameter between the buried pipe and the reamer main body becomes small, it is possible to reduce the overbreak (reamer connecting hole) opening to the ground so that shortening of the construction time may be achieved by that much and also to prevent increases in drawing resistance.

Since the cover for preventing intrusion of sediments 74, which is attached to the reamer main body 8, is provided between the reamer main body 8 and the buried pipe 1, it is further possible to prevent intrusion of sediments to the reamer main body 8 and the buried pipe 1 and to avoid increases in drawing resistance of the buried pipe 1 owing to intrusion of sediments into the reamer apparatus. It is thereby possible to lightly perform drawing operations of the buried pipe 1 without the necessity of performing the same at excess drawing force. It is also possible to prevent the coupling structure 7 from being damaged through intrusion of sediments, and diameter expanding operations by using the reamer 6 can be stably performed. Moreover, since the rotating side on the reamer main body 8 side and the non-rotating side on the side of the buried pipe 1 are sealed through the floating seal 57 in the Swivel joint 34, a mechanism for preventing intrusion of sediments exhibiting reliability and durability over a long period of time can be arranged. It is therefore possible to achieve elongation of intervals between maintenance operations. Since the cover for preventing intrusion of sediments 74 is further arranged in that its end portion on the reamer main body 8 side plunges into the reamer main body 8, it is possible to prevent intrusion of sediments from the end portion of the cover for preventing intrusion of sediments 74 on the reamer main body 8 side to the coupling structure 1 side in an even more effective manner. Since clearances 79 have been provided between the end portion on the side opposite to the reamer main body 8 side and the buried pipe 1, it is possible to secure flexibility of the reamer main body 8 with respect to the buried pipe 1, and since sediments will flow to the side of the buried pipe 1 with respect to the reamer apparatus when performing drawing operations, it is possible to prevent intrusion of sediments from between the cover for preventing intrusion of sediments 74 and the buried pipe 1.

By the provision of the partitioning member 22 in the vicinity of the aperture of the reamer main body 8 on the side of the buried pipe 1, the reamer main body 8 is reinforced by the partitioning member 22 so that it exhibits superior strength, and diameter expanding operations of the pilot hole 5 can be stably performed. Since the partitioning member 22 is provided with the injection tips 36 for discharging the drilling fluid that has entered the hollow chamber 23 (passage for the drilling fluid) of the reamer main body 8 to the side of the buried pipe 1, it is possible to prevent sediments from remaining at the rearward side of the reamer main body 8 through the drilling fluid that has been injected through the injection tips 36, and increases in drawing resistance of the buried pipe 1 owing to intrusion of sediments to the reamer apparatus can be avoided. Moreover, it is possible to wash the interior of the hollow chamber 23 upon pouring washing water through the injection tips 36 or the emission ports 15 after completion of burying operations. Since two cleaning holes 32 of relatively larger diameter are formed at the partitioning member 22, it is possible to discharge sediments and others that have entered the interior of the hollow chamber 23 by pouring washing water from one cleaning hole 32 into the hollow chamber 23 while discharging the washing water from the other cleaning hole 32, and cleaning of the interior of the hollow chamber 23 can thus be reliably performed. No clogging of the injection tips 36 or the emission ports 15 will be caused through the sediments and others that have entered the interior of the hollow chamber 23, and cutting and breaking actions of soil can be effectively exhibited at the next occasion of performing burying operations by using this reamer apparatus. In this respect, since the emission ports 15 are comprised of nozzle members 17 that are screwed to the screw holes 16 formed at the reamer main body 8, clogging can be easily eliminated by detaching the nozzle members 17 in the event clogging of emission ports 15 have occurred.

When forming the reamer 6, since the drilling portion can be comprised by fixedly attaching (for example, welding) a plurality of platy members 9 onto the outer surface of the reamer main body 8 that assumes a substantially hollow conical shape, it is possible to omit cutting processes for processing grooves, and it is possible to achieve reductions in manufacturing costs and improvements in workability. Since no groove processing is performed, the thickness of the reamer main body 8 that is of substantially hollow conical shape can be made thin so that a light-weighted structure of the entire reamer can be obtained. It is thus possible to simplify detaching operations of the reamer apparatus with respect to the rod 3 within the pits. Moreover, since each platy member 9 of the reamer 6 is comprised of the platy member main body 9*a* and the hardening-processed portion 9*b* on the surface thereof, it exhibits superior wear resistance and superb functions as a diameter expanding tool for a long period of time. Moreover, since the curing processing part 9*b* is formed through carbide particle dispersion, it is possible to easily form the curing processing part that is of high hardness. By providing the cutout parts 12 at the curing processing part 9*b* as in the above embodiment, the cutout parts 12 will comprise grooves (spaces) for escaping sediments when performing drilling so that reductions in friction resistance can be achieved.

Since the platy members 9 are disposed in a spiral manner, the reamer main body 8 may smoothly rotate for reliably expanding the diameter of the pilot hole 5. The buried pipe 1 can thus be smoothly drawn into the hole of expanded diameter. Concave grooves 13 will be formed between the platy members 9, 9, wherein the concave grooves 13 serve as discharge grooves of excavated soil. Moreover, since a plurality of emission ports 15 for injecting drilling fluid is provided at the concave grooves 13, clearances will be formed between the emission ports 15 and the inner peripheral wall of the pilot hole 5, so that drilling fluid can be easily injected through the emission ports 15. Moreover, notched portions 14 are formed at the concave grooves 13 so that it is possible to discharge sediments that have entered the concave grooves 13 from the notched portions 14, and discharge of excavated soil can be even more effectively performed. It is possible to achieve improvements of drilling performance of the reamer apparatus.

Since projection members 21 for preventing intrusion of sediments to the emission ports 15 are provided on frontward sides in the rotating direction C in the vicinity of the emission ports 15 of the reamer main body 8, it is possible to prevent intrusion of sediments to the emission ports 15 by those projection members 21. More particularly, when expanding the diameter of the pilot hole 5 through rotation of the reamer 6, the projection members 21 serve as protective barriers with respect to sediments that try to flow into the emission ports 15 so that clogging of the emission ports 15 can be avoided. It is therefore possible to reliably perform injection of drilling fluid from the respective emission ports 15, and cutting and breaking actions of soil can be stably exhibited.

While a concrete embodiment of the present invention has been so far been explained, the present invention is not to be limited to the above embodiment alone, and it may be embodied upon various modifications within the scope of the present invention. It is, for example, possible to accumulate the Swivel joint 34 in the reamer main body 8 in its entirely, or, while it is preferable in view of preventing intrusion of sediments to the Swivel joint 34 side by accumulating the main portion of the Swivel joint 34 within the reamer main body 8 and by providing the cover for preventing intrusion of sediments 34, it is also possible to employ either one of accumulating the main portion of the Swivel joint 34 within the reamer main body 8 or of providing the cover for preventing intrusion of sediments 34. It is also possible to increase/decrease the number of the emission ports 15, the discharge port 18 and the injection tip 36 and to change the hole diameters thereof. While the injection tips 36 are provided on the outer diameter (outer) side of the cover 74, it is also possible to provide the same on the inner diameter (inner) side than the supporting pieces 75 to open into the cover 74. When the injection tips 36 are formed on the outer diameter side of the cover 74, the drilling fluid that is discharged from the hollow chamber 23 will be discharged to the exterior without entering the cover 74, and intrusion of sediments or similar within the hollow chamber 23 into the cover 74 can be prevented. When arranging the injection tips 36 to open into the cover 74, a rearward flow of drilling fluid will be caused within the cover 74, and sediments that have entered the cover 74 can be discharged from the clearances 79. Moreover, cleaning of the interior of the cover 74 will be possible by suing the injection tips 36 without the necessity of disassembly after completion of operations. The injection tips 36 may thus be provided on either of the outer or inner side of the cover 74 and also on both sides. In this respect, since there may be cases in which the rod 3 is penetrated into a sloped surface such that the rod 3 projects from a sloped surface depending on places of burying the pipe, it might be possible to omit the penetration pit P1, the starting pit P2 or the attainment pit P3 when performing burying operations. Further, while the ground boring machine of the present embodiment has been arranged in which the drill driving device 2 and the drilling fluid feeder 4 are provided as separate members, they may also be formed in a uniform manner.

What is claimed is:

1. A reamer apparatus for a ground boring machine, comprising:

a substantially hollow conical reamer main body which diameter reduces towards a drawing side;

a rod connecting portion provided at a narrow diameter end portion of the reamer main body for connecting with a rod; and a coupling structure provided on an opposite side of the rod connecting portion, wherein the coupling structure has a swivel joint that allows rotation of the reamer main body with respect to the buried pipe, and a main portion of the swivel joint is substantially accumulated and extends within the reamer main body.

2. The reamer apparatus for a ground boring machine according to claim 1, wherein the swivel joint is arranged in that a rotating side on the reamer main body side and a non-rotating side on the side of the buried pipe are sealed by a floating seal.

3. A reamer apparatus for a ground boring machine, comprising:

a substantially hollow conical reamer main body which diameter reduces towards a drawing side;

a rod connecting portion provided at a narrow diameter end portion of the reamer main body for connecting with a rod;

a coupling structure provided on an opposite side of the rod connecting portion, wherein a cover for preventing intrusion of sediments is attached to the reamer main body to encompass an outer peripheral side of the coupling structure by the cover for preventing intrusion of sediments while a clearance is formed between a buried pipe and an end portion of the cover on a side that is opposite to the reamer main body side.

4. The reamer apparatus for a ground boring machine according to claim 3, wherein the cover for preventing intrusion of sediments is arranged in that an end portion thereof on the reamer main body side is plunged into the reamer main body.

5. A reamer apparatus for a ground boring machine, comprising:

a substantially hollow conical reamer main body which diameter reduces towards a drawing side, wherein a partitioning member is disposed in the vicinity of an aperture of the reamer main body on a side of a buried pipe, a passage is formed within the reamer main body through which drilling fluid is supplied for injecting the drilling fluid to a portion to be drilled through emission ports, and an injection tip is provided at the partitioning member through which the drilling fluid that has entered the passage is discharged to the side of the buried pipe.

6. A reamer apparatus for a ground boring machine, comprising:

a substantially hollow conical reamer main body which diameter reduces towards a drawing side;

a rod connecting portion provided at a narrow diameter end portion of the reamer main body for connecting with a rod; and a coupling structure provided on an opposite side of the rod connecting portion, wherein:

the coupling structure has a swivel joint that allows rotation of the reamer main body with respect to a buried pipe, and a main portion of the swivel joint is substantially accumulated in the reamer main body, and the swivel joint is arranged in that a rotating side on the reamer main body side and a non-rotating side on the side of the buried pipe are sealed by a floating seal.

* * * * *